US012604994B2

(12) United States Patent
Xia et al.

(10) Patent No.: US 12,604,994 B2
(45) Date of Patent: Apr. 21, 2026

(54) THICKNESS-ADJUSTABLE AIR MATTRESS STRUCTURE

(71) Applicant: Zhejiang Natural Outdoor Goods Inc., Taizhou (CN)

(72) Inventors: Yonghui Xia, Taizhou (CN); Junwei Yao, Taizhou (CN); Wenwen Ji, Taizhou (CN); Weiyi Ma, Taizhou (CN); Zirui Cai, Taizhou (CN)

(73) Assignee: Zhejiang Natural Outdoor Goods Inc., Taizhou (CN)

( * ) Notice: Subject to any disclaimer, the term of this patent is extended or adjusted under 35 U.S.C. 154(b) by 216 days.

(21) Appl. No.: 18/415,708

(22) Filed: Jan. 18, 2024

(65) Prior Publication Data

US 2025/0160533 A1 May 22, 2025

(30) Foreign Application Priority Data

Nov. 17, 2023 (CN) ..... 202323133023.3
Dec. 22, 2023 (CN) ..... 202323526669.8

(51) Int. Cl.
*A47C 27/08* (2006.01)

(52) U.S. Cl.
CPC ..... *A47C 27/088* (2013.01); *A47C 27/081* (2013.01)

(58) Field of Classification Search
CPC .... A47C 27/088; A47C 27/081; A47C 27/087
See application file for complete search history.

(56) References Cited

U.S. PATENT DOCUMENTS 2,371,788 A * 3/1945 Weeber ..... A47C 27/144 5/655.9
2,768,924 A * 10/1956 Wright ..... A47C 27/144 428/72
3,133,853 A * 5/1964 Knox ..... C08J 9/34 264/46.7
3,222,697 A * 12/1965 Scheermesser ..... A47C 27/15 5/636
3,885,257 A * 5/1975 Rogers ..... A61F 5/01 5/724
4,025,974 A * 5/1977 Lea ..... B29C 66/8181 5/709

(Continued)

*Primary Examiner* — Myles A Throop
(74) *Attorney, Agent, or Firm* — Bayramoglu Law Offices LLC

(57) ABSTRACT

A thickness-adjustable air mattress structure includes an airbag body and an elastic sponge. The airbag body is provided with an air chamber. The elastic sponge is in the shape of a square or long strip and provided in the air chamber. An upper surface of the elastic sponge is fixedly connected to an upper surface layer, and a lower surface of the elastic sponge is fixedly connected to a lower surface layer. The elastic sponge is provided with a plurality of first through-seams and a plurality of second through-seams. The first through-seams and the second through-seams each are provided with a U-shaped, C-shaped, or V-shaped cross-section. When the airbag body is inflated and the elastic sponge is vertically expanded, the first through-seams and the second through-seams are expanded. As the elastic sponge can be vertically expanded, it can have a small thickness to fill the air chamber.

16 Claims, 6 Drawing Sheets

(56) References Cited

U.S. PATENT DOCUMENTS

| | | | | | |
|---|---|---|---|---|---|
| 4,397,053 | A * | 8/1983 | Fanti | A47C 27/15 | 5/724 |
| 4,624,877 | A * | 11/1986 | Lea | A47C 27/088 | 156/303.1 |
| 5,152,018 | A * | 10/1992 | Lea | A47C 27/088 | 5/709 |
| 5,201,489 | A * | 4/1993 | Wolf | B29C 33/485 | 267/141 |
| 5,491,852 | A * | 2/1996 | Maucher | A47C 27/146 | 5/730 |
| 5,705,252 | A * | 1/1998 | Lea | A47C 27/144 | 428/158 |
| 6,237,173 | B1 * | 5/2001 | Schlichter | A47C 27/144 | 5/722 |
| 6,446,289 | B1 * | 9/2002 | Su | A47C 27/18 | 5/709 |
| D653,895 | S * | 2/2012 | Reisenhus | D6/596 | |
| D675,051 | S * | 1/2013 | Sobran | D6/601 | |
| 9,095,221 | B1 * | 8/2015 | Tiffany | A47C 17/04 | |
| 11,019,935 | B2 * | 6/2021 | Marson | A47C 27/15 | |
| 2006/0210766 | A1 * | 9/2006 | Press | A41D 31/04 | 427/256 |
| 2006/0260060 | A1 * | 11/2006 | Apperson | A47C 27/15 | 5/691 |
| 2008/0060139 | A1 * | 3/2008 | Mossbeck | A47C 27/146 | 5/724 |
| 2011/0311765 | A1 * | 12/2011 | Lincoln | A47C 27/088 | 428/131 |

* cited by examiner

THICKNESS-ADJUSTABLE AIR MATTRESS STRUCTURE

CROSS REFERENCE TO THE RELATED APPLICATIONS

This application is based upon and claims priority to Chinese Patent Applications No. 202323133023.3, filed on Nov. 17, 2023, and No. 202323526669.8, filed on Dec. 22, 2023, the entire contents of which are incorporated herein by reference.

TECHNICAL FIELD

The present disclosure belongs to the technical field of air mattresses, and in particular relates to a thickness-adjustable air mattress structure.

BACKGROUND

At present, a layer of sponge is filled inside air mattresses on the market to form sponge-filled air mattresses, which has comfortable, warm, and smooth features. However, they are heavy. In order to reduce the weight of the sponge-filled air mattresses and make them portable, the entire thin sponge is cut and punched. However, cutting and punching will generate a large amount of sponge waste, and requires that the thickness of the sponge before cutting is equivalent to that of the air mattress after inflation, leading to problems such as large transportation volume and high purchase cost of the sponge.

In view of this, it is desirable to design a thickness-adjustable air mattress structure with a thin elastic sponge that meets the usage needs of air mattresses after expanding.

SUMMARY

In order to reduce the fabrication cost of sponge-filled air mattresses, the present disclosure provides a thickness-adjustable air mattress structure.

The present disclosure adopts the following technical solutions.

A thickness-adjustable elastic sponge includes is provided, where a middle part of the elastic sponge along the thickness direction is provided with first through-seams and second through-seams; a plurality of first through-seams are spaced apart from each other and arranged in a straight line along a length or width direction of the elastic sponge; a plurality of second through-seams are spaced apart from each other and arranged in a straight line along the length or width direction of the elastic sponge; the first through-seams and the second through-seams run through two opposite sides of the elastic sponge along a direction vertical to the arrangement direction; and the first through-seams do not intersect with the second through-seams;

a cross-section of each of the first through-seams is U-shaped, C-shaped, or V-shaped, and open downwards; a cross-section of each of the second through-seams is U-shaped, C-shaped, or V-shaped, and open upwards; two opening edges of each of the first through-seams extend respectively to positions inside or above openings of two adjacent second through-seams; the second through-seams are located below the first through-seams; and two opening edges of each of the second through-seams extend respectively to positions inside or below openings of two adjacent first through-seams; and middle connecting parts rotatable up and down or compressible are formed between the first through-seams and the second through-seams, such that the first through-seams and the second through-seams are allowed to vertically expand to adjust a thickness of the elastic sponge.

As an alternative or supplement of the thickness-adjustable elastic sponge, the opening edges of each of the first through-seams and the opening edges of each of the second through-seams are provided with through-holes, and a wall of the through-hole is communicated with the first through-seam or the second through-seam; and when the elastic sponge is vertically expanded, the through-hole is expanded and takes a groove shape.

As an alternative or supplement of the thickness-adjustable elastic sponge, a shape of the cross-section of the second through-seam is identical to or different from a shape of the cross-section of the first through-seam.

As an alternative or supplement of the thickness-adjustable elastic sponge, when the first through-seams and the second through-seams cause respective opening edges to extend to positions inside each other's openings, the middle connecting parts are rotatable, with a maximum rotation angle of 90-180°; and when the first through-seams and the second through-seams cause respective opening edges to extend to positions above or below each other's openings, the middle connecting parts are compressible.

As an alternative or supplement of the thickness-adjustable elastic sponge, a part of the elastic sponge between each two adjacent first through-seams forms an upper spacer; a part of the elastic sponge between each two adjacent second through-seams forms a lower spacer; and the upper spacer is parallel and misaligned with the lower spacer.

As an alternative or supplement of the thickness-adjustable elastic sponge, the elastic sponge is a hexahedral sponge cushion, silicone cushion, rubber cushion, or latex cushion.

As an alternative or supplement of the thickness-adjustable elastic sponge, the elastic sponge is in the shape of a square or long strip; the first through-seams and the second through-seams run through left and right side surfaces or front and rear side surfaces of the elastic sponge; all the first through-seams and all the second through-seams are spaced along the length or width direction of the elastic sponge; and the first through-seams do not intersect with the second through-seams.

A thickness-adjustable air mattress structure includes an airbag body and the elastic sponge, where the airbag body includes an upper surface layer and a lower surface layer; and a sealed air chamber is formed between the upper surface layer and the lower surface layer; and the elastic sponge is provided in the air chamber; an upper surface of the elastic sponge is fixedly connected to the upper surface layer, and a lower surface of the elastic sponge is fixedly connected to the lower surface layer; and when the airbag body is inflated, the elastic sponge is vertically expanded.

As an alternative or supplement of the thickness-adjustable air mattress structure, a part of the elastic sponge located above the first through-seams forms an upper sponge layer; a part of the elastic sponge located below the second through-seams forms a lower sponge layer; the upper sponge layer is fixedly connected to the upper surface layer; and the lower sponge layer is fixedly connected to the lower surface layer.

As an alternative or supplement of the thickness-adjustable air mattress structure, the upper surface of the elastic sponge is bonded to the upper surface layer; the lower surface of the elastic sponge is bonded to the lower surface layer; the upper surface layer is provided with an inflation and deflation valve, and the inflation and deflation valve is configured to inflate and deflate the air chamber; when the air chamber is inflated, upper and lower parts of the elastic sponge are vertically separated, and the middle connecting parts rotate; and when the air chamber is deflated, the upper and lower parts of the elastic sponge are vertically combined, and the middle connecting parts are reset.

The present disclosure has the following beneficial effects.

1. In the present disclosure, the elastic sponge can be vertically expanded or contracted during use, reducing the volume of the air mattress and the volume of the elastic sponge after contraction. The thin elastic sponge can be expanded to a specified thickness to meet the filling requirements of the air chamber of the air mattress body.

2. The elastic sponge makes the air mattress comfort, warm, and smooth.

3. There is no need to punch the elastic sponge, reducing the amount of waste generated.

In addition, the usage of the filling sponge is reduced, effectively reducing the fabrication cost of the air mattress.

4. The through-holes can reduce stress at the opening edges of the first through-seam or the second through-seam, avoiding tearing of the opening edges of the first through-seam or the second through-seam when the middle connecting parts rotate.

BRIEF DESCRIPTION OF THE DRAWINGS

In order to clearly illustrate the technical solutions in the embodiments of the present disclosure or in the prior art, the drawings required in the description of the embodiments and the prior art will be briefly described below.

REFERENCE NUMERALS

Figure 1:
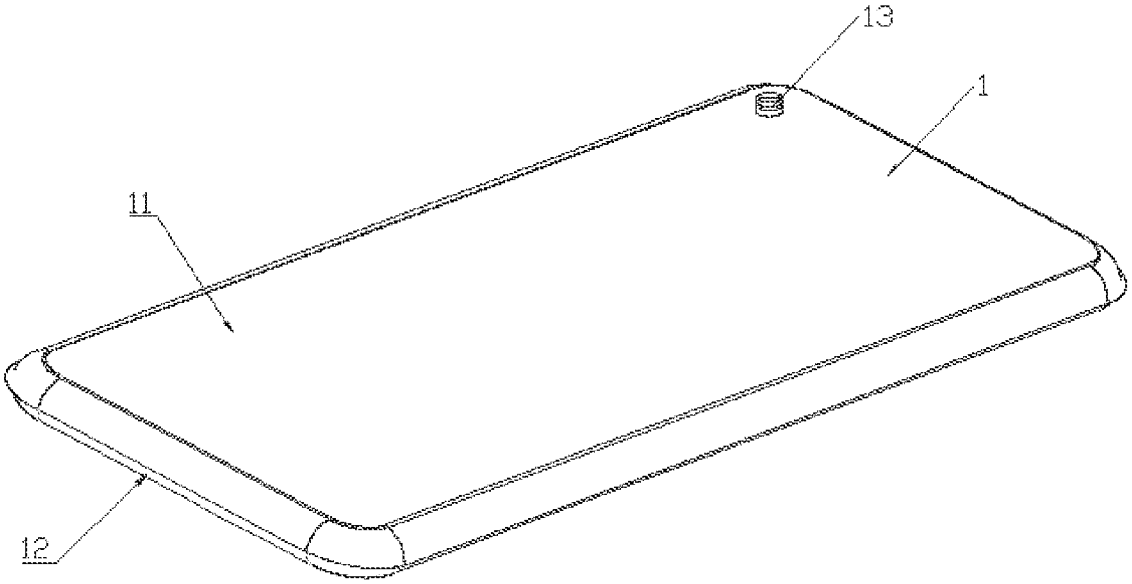
FIG. 1 is a stereoscopic diagram of an air mattress according to the present disclosure.

1. airbag body; 11. upper surface layer; 12. lower surface layer; 13. inflation and deflation valve; 2. elastic sponge; 21. upper sponge layer; 22. lower sponge layer; 23. upper spacer; 24. lower spacer; 25. middle connecting part; 26. through-hole; 3. first through-seam; and 4. second through-seam.

DETAILED DESCRIPTION OF THE EMBODIMENTS

The technical solutions in the embodiments of the present disclosure are clearly and completely described below with reference to the drawings. The described embodiments are merely a part rather than all of the embodiments of the present disclosure. All other embodiments derived from the embodiments in the present disclosure by those of ordinary skill in the art without creative efforts should fall within the protection scope of the present disclosure.

Embodiment 1

As shown in FIGS. 1 to 6, this embodiment designs a thickness-adjustable air mattress structure, including airbag body 1 and elastic sponge 2.

The airbag body 1 includes upper surface layer 11 and lower surface layer 12. A sealed air chamber is formed between the upper surface layer 11 and the lower surface layer 12. The upper surface layer 11 and the lower surface layer 12 are made of thermoplastic polyurethane (TPU) or other waterproof and breathable materials. The upper surface layer 11 is provided with inflation and deflation valve 13. The inflation and deflation valve 13 is configured to inflate and deflate the air chamber. An edge of the upper surface layer 11 is connected to an edge of the lower surface layer 12 by hot melt welding.

The elastic sponge 2 is in the shape of a square or long strip and is provided in the air chamber. The elastic sponge 2 can take the shape of a hexahedron. When the elastic sponge is used for an air mattress, six sides of the elastic sponge 2 can be flat. When the elastic sponge is used for a pillow cushion or other soft cushion, the sides of the elastic sponge 2 can be arc-shaped or curved. The elastic sponge 2 can be a sponge cushion, silicone cushion, rubber cushion, latex cushion, or other soft mats made of elastic materials.

An upper surface of the elastic sponge 2 is fixedly connected to the upper surface layer 11, and a lower surface of the elastic sponge 2 is fixedly connected to the lower surface layer 12. The fixed connection can be implemented by bonding. That is, the upper surface of the elastic sponge is bonded to the upper surface layer 11; and the lower surface of the elastic sponge 2 is bonded to the lower surface layer 12.

The elastic sponge 2 is provided with a plurality of first through-seams 3 and a plurality of second through-seams 4. The first through-seams 3 are spaced apart from each other, and the second through-seams 4 are spaced apart from each other. The first through-seams 3 and the second through-seams 4 are arranged on side surfaces of the elastic sponge 2. Specifically, the first through-seams 3 and the second through-seams 4 are arranged in two manners.

A first arrangement manner of the first through-seams 3 and the second through-seams 4 is as follows. The first through-seams 3 run through left and right side surfaces of the elastic sponge 2, and all the first through-seams 3 are horizontally spaced in a straight line along a length direction of the elastic sponge 2. The second through-seams 4 run through the left and right side surfaces of the elastic sponge 2, and all the second through-seams 4 are horizontally spaced in a straight line along the length direction of the elastic sponge 2. Each two adjacent first through-seams 3 do not intersect with each other, and the first through-seams 3 do not intersect with the second through-seams 4. The first through-seams 3 and/or the second through-seams 4 separate upper and lower parts of the side surfaces of the elastic sponge 2, and the first through-seams 3 and/or the second through-seams 4 located at ends of the arrangement direction separate upper and lower parts of front and rear side surfaces of the elastic sponge 2. In this way, the first through-seams 3 and the second through-seams 4 are expandable vertically to expand the elastic sponge 2 vertically when the airbag body 1 is inflated.

A second arrangement manner of the first through-seams 3 and the second through-seams 4 is as follows. The first through-seams 3 run through front and rear side surfaces of the elastic sponge 2, and all the first through-seams 3 are horizontally spaced in a straight line along a width direction of the elastic sponge 2. The second through-seams 4 run through the front and rear side surfaces of the elastic sponge 2, and all the second through-seams 4 are horizontally spaced in a straight line along the width direction of the elastic sponge 2. Each two adjacent first through-seams 3 do not intersect with each other, and the first through-seams 3 do not intersect with the second through-seams 4. The first through-seams 3 and/or the second through-seams 4 separate upper and lower parts of the side surfaces of the elastic sponge 2, and the first through-seams 3 and/or the second through-seams 4 located at ends of the arrangement direction separate upper and lower parts of left and right side surfaces of the elastic sponge 2. In this way, the first through-seams 3 and the second through-seams 4 are expandable vertically to expand the elastic sponge 2 vertically when the airbag body 1 is inflated.

It should be noted that corners of the elastic sponge 2 can be arranged in different shapes or chamfers without affecting the two arrangement manners of the first through-seams 3 and the second through-seams 4.

A cross-section of the first through-seam 3 is U-shaped, C-shaped, or V-shaped, and a cross-section of the second through-seam 4 is also U-shaped, C-shaped, or V-shaped. In order to expand the elastic sponge 2, the first through-seams 3 and the second through-seams 4 adopt a misaligned arrangement mode. Partial side surfaces of the elastic sponge 2 make incomplete first through-seams 3 and second through-seams 4 in a width direction, resulting in J-shaped, L-shaped, or diagonal first through-seams 3 and second through-seams 4 in the width direction.

An implementation method for the misaligned arrangement mode of the first through-seams 3 and the second through-seams 4 is as follows. The first through-seams 3 are open downwards, and the second through-seams 4 are open upwards. The second through-seams 4 are located below the first through-seams 3. Two opening edges of each of the first through-seams 3 extend respectively to positions inside or above openings of two adjacent second through-seams 4. Two opening edges of each of the second through-seams 4 extend respectively to positions inside or below openings of two adjacent first through-seams 3.

Figure 4:
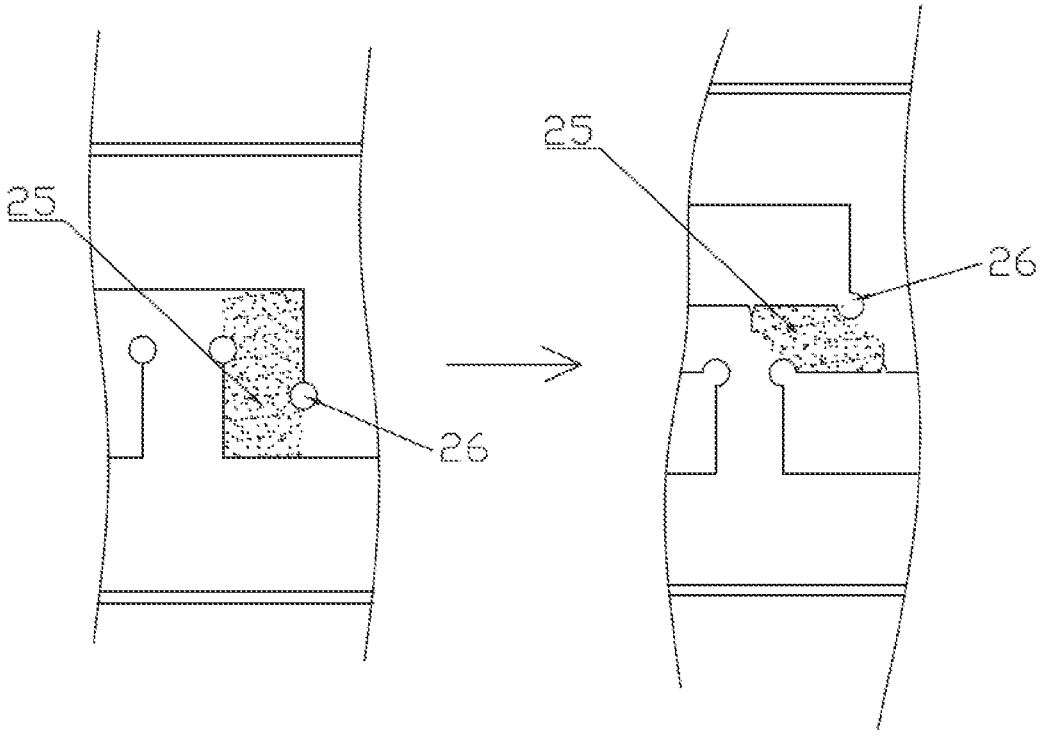
FIG. 4 is a schematic diagram showing a middle connecting part before and after rotation.
Figure 5:
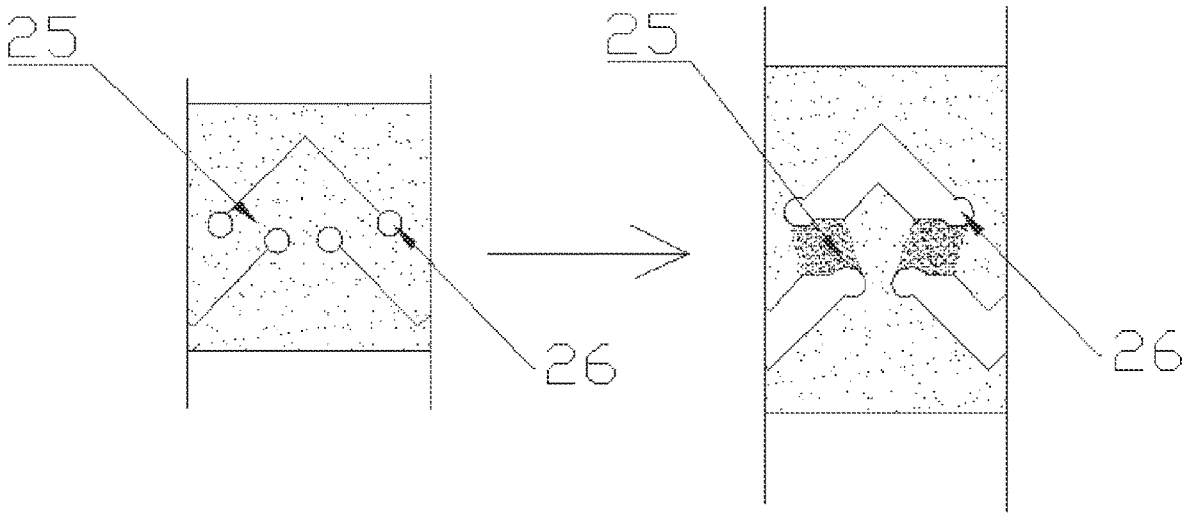
FIG. 5 is a sectional view of another unexpanded elastic sponge.

When the elastic sponge 2, which includes the first through-seams 3 and the second through-seams 4 adopting a misaligned arrangement mode, is vertically expanded, parts between the second through-seams 4 and the first through-seams 3, namely middle connecting parts, rotate. The middle connecting parts at two sides of same upper spacer 23 or same lower spacer 24 move in a mirror image, causing the first through-seams 3 and the second through-seams 4 to expand, such that the elastic sponge 2 can reach a required expanded height. When the airbag body 1 is inflated and the elastic sponge 2 is vertically expanded, the first through-seams 3 and the second through-seams 4 can be expanded. When the first through-seams and the second through-seams cause respective opening edges to extend to positions inside each other's openings, the middle connecting parts can rotate, with a maximum rotation angle of 90-180°. When the opening edges of the first through-seams 3 and the second through-seams extend to positions above or below each other's openings, the middle connecting parts can be compressed and deformed into a single middle connecting part to rotate, with a maximum rotation angle greater than or equal to 900 and less than 180°, as shown in FIG. 4.

Figure 2:
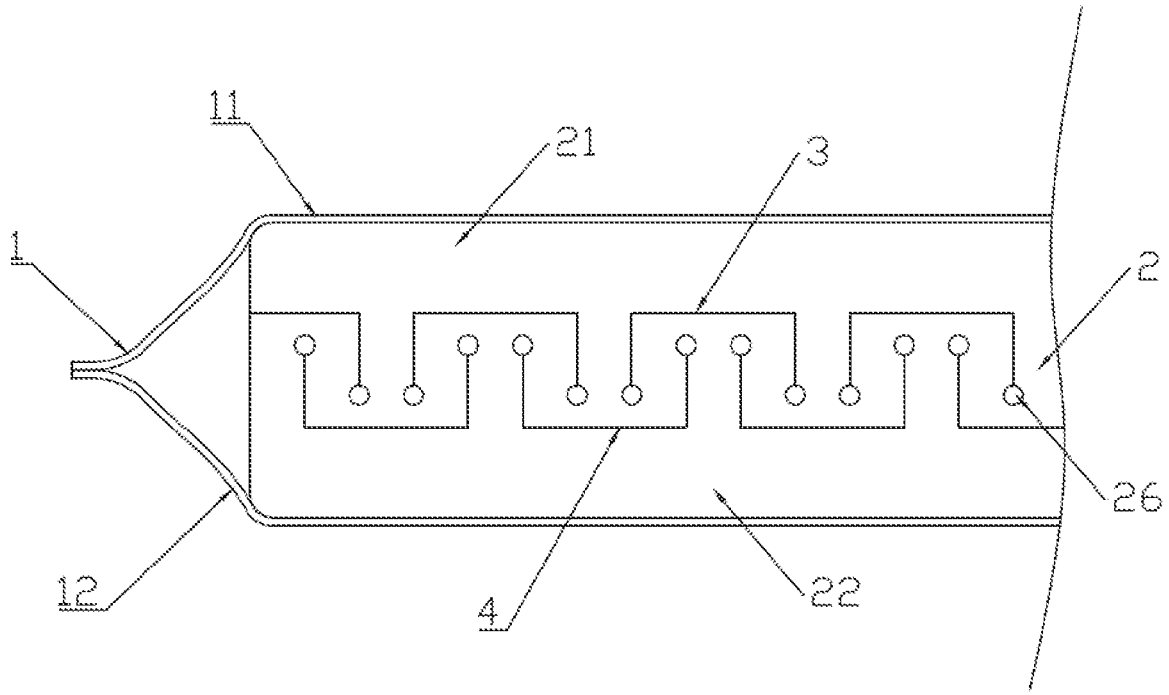
FIG. 2 is a sectional view of an unexpanded elastic sponge.
Figure 3:
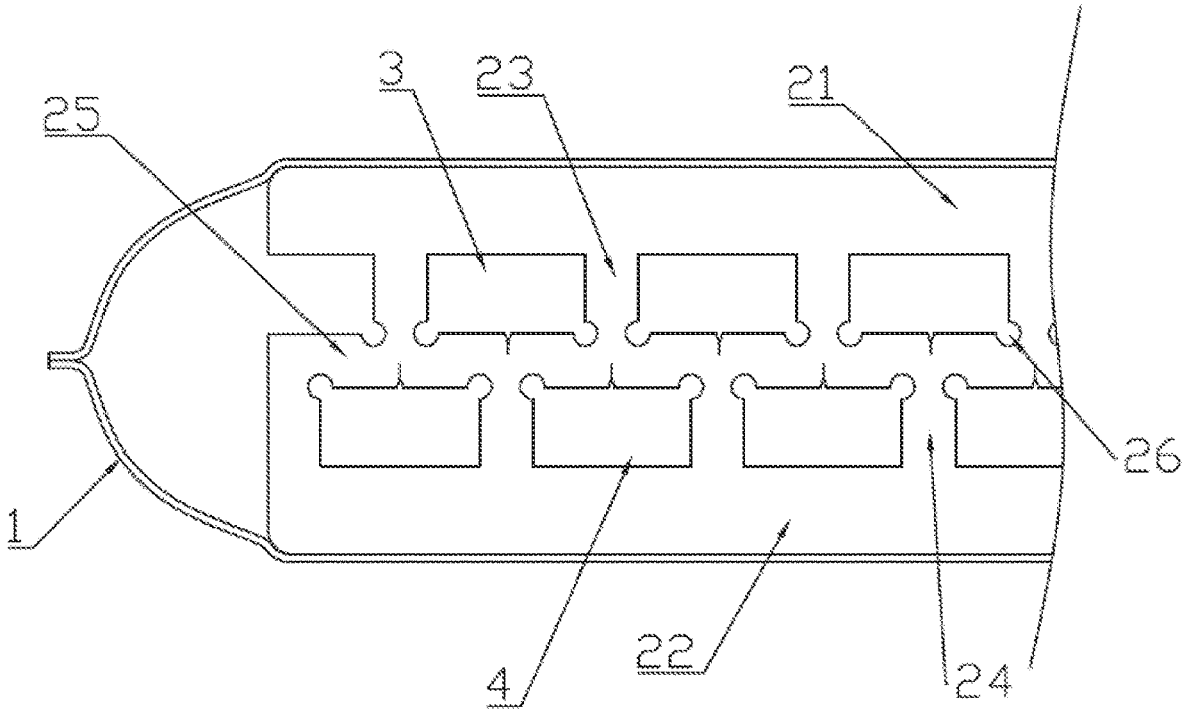
FIG. 3 is a sectional view of an expanded elastic sponge.

The second through-seams 4 and the first through-seams 3 can be provided with a U-shaped cross-section, as shown in FIGS. 2 and 3. The second through-seams 4 and the first through-seams 3 can be provided with a C-shaped cross-section, as shown in FIG. 4. The second through-seams 4 can be provided with a U-shaped cross-section and the first through-seams 3 can be provided with a V-shaped cross-section (not shown in the figure). The second through-seams 4 can be provided with a V-shaped cross-section, and first through-seams 3 can be provided with a U-shaped cross-section (not shown in the figure). In addition, different second through-seams 4 can have different cross-sectional shapes, and different first through-seams 3 can have different cross-sectional shapes. Overall, the second through-seams 4 and the first through-seams 3 can be provided with a U-shaped, C-shaped, or V-shaped cross-section.

Through the second through-seams 4 and the first through-seams 3, a part of the elastic sponge 2 located above the first through-seams 3 forms upper sponge layer 21, and a part of the elastic sponge 2 located below the second through-seams 4 forms lower sponge layer 22. A part of the elastic sponge 2 located between each two adjacent first through-seams 3 forms the upper spacer 23, which protrudes downwards from the upper sponge layer 21. Apart of the elastic sponge 2 located between each two adjacent second through-seams 4 forms the lower spacer 24, which protrudes upwards from the lower sponge layer 22. Parts of the elastic sponge 2 located between the first through-seams 3 and the second through-seams 4 form the middle connecting parts 25, which are connected between a lower end of the upper spacer 23 and an upper end of the lower spacer 24.

The upper sponge layer 21 is fixedly connected to the upper surface layer 11, and the lower sponge layer 22 is fixedly connected to the lower surface layer 12. When the elastic sponge 2 is expanded, the upper sponge layer 21 and the lower sponge layer 22 move away from each other.

The upper spacer 23 is integrated with the upper sponge layer 21, and the lower spacer 24 is integrated with the lower sponge layer 22. When the elastic sponge 2 is expanded, the upper spacer 23 and the lower spacer 24 move away from each other. During this process, the upper spacer 23 and the lower spacer 24 remain parallel and misaligned with each other. That is, when the air chamber is inflated, the upper and lower parts of the elastic sponge are vertically separated, and the middle connecting parts rotate. When the air chamber is deflated, the upper and lower parts of the elastic sponge are vertically combined, and the middle connecting parts are reset.

The middle connecting parts 25 are connected to the upper spacer 23 and the lower spacer 24. When the elastic sponge 2 is expanded, the first through-seams 3 and the second through-seams 4 are expanded, and the middle connecting parts 25 rotate.

The opening edges of each of the first through-seams and the opening edges of each of the second through-seams are provided with through-holes 26, and a wall of the through-hole 26 is communicated with the first through-seam or the second through-seam. When the elastic sponge is vertically expanded, the through-hole 26 is expanded and takes a groove shape. The through-holes 26 are configured to reduce stress at the opening edges of the first through-seam or the second through-seam, avoiding tearing of the opening edges of the first through-seam or the second through-seam when the middle connecting parts 25 rotate.

In this embodiment, as the elastic sponge 2 can be vertically expanded, the elastic sponge 2 can have a small thickness to fill the air chamber of the airbag body 1, reducing fabrication costs, improving the utilization of the elastic sponge 2, and ensuring that the air mattress is comfortable, warm, and smooth.

Embodiment 2

As shown in FIGS. 1 to 6, this embodiment designs thickness-adjustable elastic sponge 2. The middle part of the elastic sponge 2 along the thickness direction is provided with first through-seams 3 and second through-seams 4. A plurality of first through-seams 3 are spaced apart from each other and arranged in a straight line along a length or width direction of the elastic sponge 2. A plurality of second through-seams 4 are spaced apart from each other and arranged in a straight line along the length or width direction of the elastic sponge 2. The first through-seams 3 and the second through-seams 4 run through two opposite sides of the elastic sponge 2 along a direction vertical to the arrangement direction. The first through-seams 3 and the second through-seams 4 do not intersect with each other.

A cross-section of each of the first through-seams 3 is U-shaped, C-shaped, or V-shaped, and open downwards. A cross-section of each of the second through-seams 4 is U-shaped, C-shaped, or V-shaped, and open upwards. Two opening edges of each of the first through-seams 3 extend respectively to positions inside or above openings of two adjacent second through-seams 4. The second through-seams 4 are located below the first through-seams 3, and two opening edges of each of the second through-seams 4 extend respectively to positions inside or below openings of two adjacent first through-seams 3.

Figure 6:
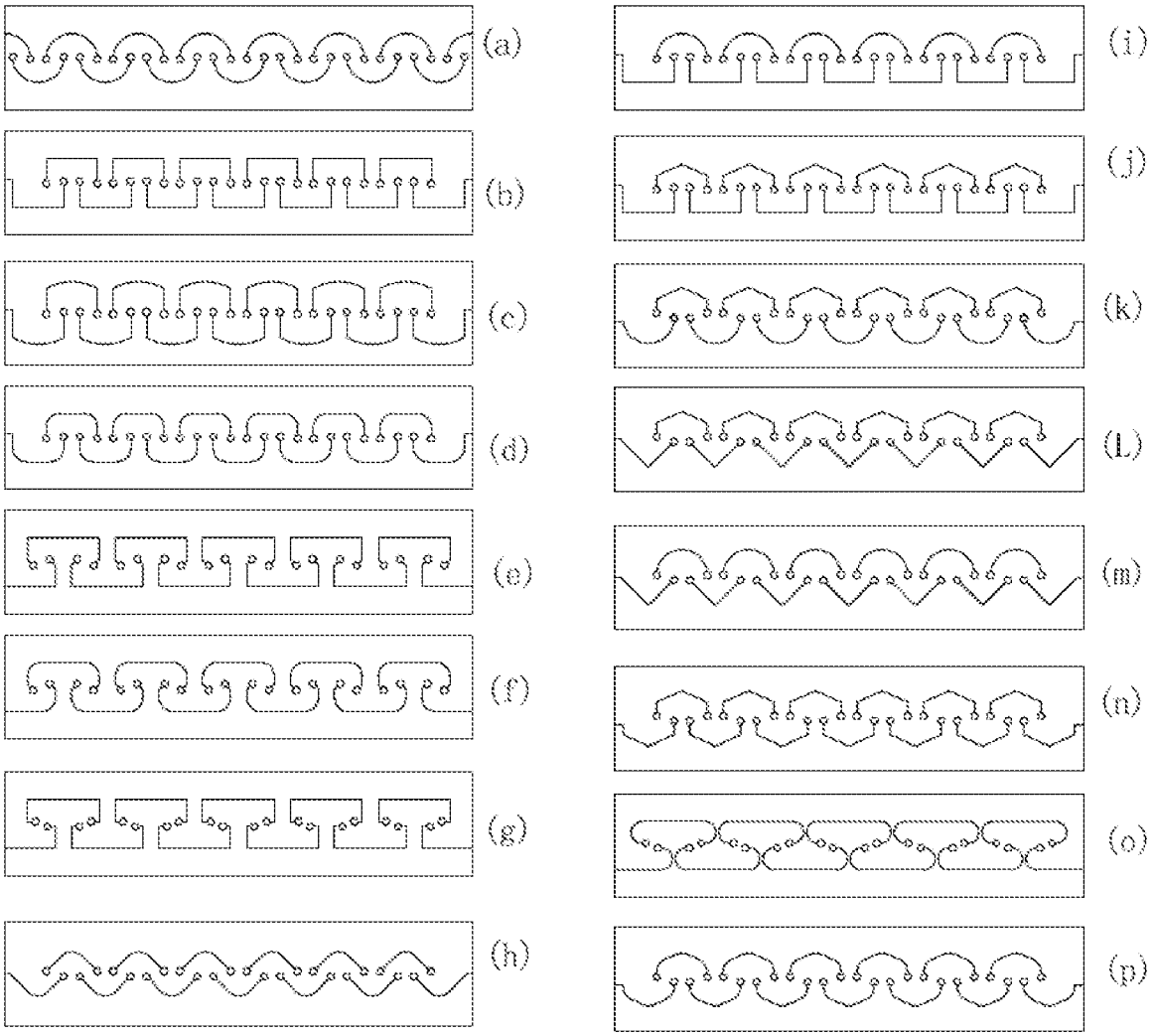
FIG. 6 is a schematic diagram showing multiple arrangement patterns (denoted by (a) to (p)) of second through-seams and first through-seams.

In FIG. 6, (a) to (p) show simple variations of the second through-seams 4 and the first through-seams 3 based on the U-shaped, C-shaped, or V-shaped designs, which are deemed as one of the U-shaped, C-shaped, or V-shaped designs. Based on conventional understandings, other variations not mentioned above can still be regarded as U-shaped, C-shaped, or V-shaped through-seam structures, and fall within the protection scope of the present disclosure.

Middle connecting parts 25 rotatable up and down are formed between the first through-seams 3 and the second through-seams 4, such that the first through-seams 3 and the second through-seams 4 are allowed to vertically expand to adjust a thickness of the elastic sponge 2.

The opening edges of each of the first through-seams 3 and the opening edges of each of the second through-seams 4 are provided with through-holes 26, and a wall of the through-hole 26 is communicated with the first through-seam 3 or the second through-seam 4. When the elastic sponge 2 is vertically expanded, the through-hole 26 is expanded and takes a groove shape. The through-holes 26 are configured to reduce stress at the opening edges of the first through-seam 3 or the second through-seam 4, avoiding tearing of the opening edges of the first through-seam 3 or the second through-seam 4 when the middle connecting parts 25 rotate.

A shape of the cross-section of the second through-seam 4 is identical to or different from a shape of the cross-section of the first through-seam 3.

A maximum rotation angle of the middle connecting parts 25 is 90-180°.

The elastic sponge 2 forms upper spacer 23 between each two adjacent first through-seams 3, and the elastic sponge 2 forms lower spacer 24 between each two adjacent second through-seams 4. The upper spacer 23 is parallel and misaligned with the lower spacer 24.

The elastic sponge 2 is a hexahedral sponge cushion, silicone cushion, rubber cushion, or latex cushion.

The elastic sponge 2 is in the shape of a square or long strip. The first through-seams 3 and the second through-seams 4 run through left and right side surfaces or front and rear side surfaces of the elastic sponge 2. All the first through-seams 3 and all the second through-seams 4 are spaced along the length or width direction of the elastic sponge 2, and the first through-seams 3 do not intersect with the second through-seams.

The above embodiments are merely provided for a clear description of the present disclosure, rather than to limit or exhaust the implementations of the present disclosure. Therefore, obvious modifications or variations made to the present disclosure still fall within the protection scope of the present disclosure.

What is claimed is:

1. A thickness-adjustable elastic sponge, wherein a middle part of the thickness-adjustable elastic sponge along a thickness direction is provided with a plurality of first through-seams and a plurality of second through-seams; the plurality of first through-seams are spaced apart from each other and arranged in a first straight line along a length or width direction of the thickness-adjustable elastic sponge; the plurality of second through-seams are spaced apart from each other and arranged in a second straight line along the length or width direction of the thickness-adjustable elastic sponge; the plurality of first through-seams and the plurality of second through-seams run through two opposite sides of the thickness-adjustable elastic sponge along a direction vertical to an arrangement direction; and the plurality of first through-seams do not intersect with the plurality of second through-seams;

a cross-section of each of the plurality of first through-seams is U-shaped, C-shaped, or V-shaped, and open downwards; a cross-section of each of the plurality of second through-seams is U-shaped, C-shaped, or V-shaped, and open upwards; two opening edges of each of the plurality of first through-seams extend respectively to positions inside or above openings of two adjacent second through-seams; the plurality of second through-seams are located below the plurality of first through-seams; and two opening edges of each of the plurality of second through-seams extend respectively to positions inside or below openings of two adjacent first through-seams, wherein at least a portion of each first through-seam of the plurality of first-through-seams is partially enveloped by a corresponding second through-seam of the plurality of second-through seam when the thickness-adjustable elastic sponge is deflated; and middle connecting parts rotatable up and down or compressible are formed between the plurality of first through-seams and the plurality of second through-seams, such that the plurality of first through-seams and the plurality of second through-seams are allowed to vertically expand to adjust a thickness of the thickness-adjustable elastic sponge, wherein the at least a portion of each first through-seam of the plurality of first-through-seams is above the corresponding second through-seam of the plurality of second-through seam when the thickness-adjustable elastic sponge is inflated.

2. The thickness-adjustable elastic sponge according to claim 1, wherein the opening edges of each of the plurality of first through-seams and the opening edges of each of the plurality of second through-seams are provided with through-holes, and a wall of each of the through-holes is communicated with each of the plurality of first through-seams or each of the plurality of second through-seams; and when the thickness-adjustable elastic sponge is vertically expanded, each of the through-holes is expanded and takes a groove shape.

3. The thickness-adjustable elastic sponge according to claim 2, wherein a shape of the cross-section of each of the plurality of second through-seams is identical to or different from a shape of the cross-section of each of the plurality of first through-seams.

4. The thickness-adjustable elastic sponge according to claim 2, wherein when the plurality of first through-seams and the plurality of second through-seams cause respective opening edges to extend to positions inside each other's openings, the middle connecting parts are rotatable, with a maximum rotation angle of 90-180°; and when the plurality of first through-seams and the plurality of second through-seams cause respective opening edges to extend to positions above or below each other's openings, the middle connecting parts are compressible.

5. The thickness-adjustable elastic sponge according to claim 2, wherein the thickness-adjustable elastic sponge is a hexahedral sponge cushion, silicone cushion, rubber cushion, or latex cushion.

6. The thickness-adjustable elastic sponge according to claim 1, wherein a part of the thickness-adjustable elastic sponge between each two adjacent first through-seams forms an upper spacer; a part of the thickness-adjustable elastic sponge between each two adjacent second through-seams forms a lower spacer; and the upper spacer is parallel and misaligned with the lower spacer.

7. The thickness-adjustable elastic sponge according to claim 1, wherein the thickness-adjustable elastic sponge is in a shape of a square or long strip; the plurality of first through-seams and the plurality of second through-seams run through left and right side surfaces or front and rear side surfaces of the thickness-adjustable elastic sponge; the plurality of first through-seams and the plurality of second through-seams are spaced along the length or width direction of the thickness-adjustable elastic sponge; and the plurality of first through-seams do not intersect with the plurality of second through-seams.

8. A thickness-adjustable air mattress structure, comprising an airbag body and the thickness-adjustable elastic sponge according to claim 1, wherein the airbag body comprises an upper surface layer and a lower surface layer; and a sealed air chamber is formed between the upper surface layer and the lower surface layer; and the thickness-adjustable elastic sponge is provided in the sealed air chamber; an upper surface of the thickness-adjustable elastic sponge is fixedly connected to the upper surface layer, and a lower surface of the thickness-adjustable elastic sponge is fixedly connected to the lower surface layer; and when the airbag body is inflated, the thickness-adjustable elastic sponge is vertically expanded.

9. The thickness-adjustable air mattress structure according to claim 8, wherein a part of the thickness-adjustable elastic sponge located above the plurality of first through-seams forms an upper sponge layer, and a part of the thickness-adjustable elastic sponge located below the plurality of second through-seams forms a lower sponge layer; the upper sponge layer is fixedly connected to the upper surface layer; and the lower sponge layer is fixedly connected to the lower surface layer.

10. The thickness-adjustable air mattress structure according to claim 9, wherein the upper surface of the thickness-adjustable elastic sponge is bonded to the upper surface layer; the lower surface of the thickness-adjustable elastic sponge is bonded to the lower surface layer; the upper surface layer is provided with an inflation and deflation valve, and the inflation and deflation valve is configured to inflate and deflate the sealed air chamber; when the sealed air chamber is inflated, upper and lower parts of the thickness-adjustable elastic sponge are vertically separated, and the middle connecting parts rotate; and when the sealed air chamber is deflated, the upper and lower parts of the thickness-adjustable elastic sponge are vertically combined, and the middle connecting parts are reset.

11. The thickness-adjustable air mattress structure according to claim 8, wherein the opening edges of each of the plurality of first through-seams and the opening edges of each of the plurality of second through-seams are provided with through-holes, and a wall of each of the through-holes is communicated with each of the plurality of first through-seams or each of the plurality of second through-seams; and when the thickness-adjustable elastic sponge is vertically expanded, each of the through-holes is expanded and takes a groove shape.

12. The thickness-adjustable air mattress structure according to claim 11, wherein a shape of the cross-section of each of the plurality of second through-seams is identical to or different from a shape of the cross-section of each of the plurality of first through-seams.

13. The thickness-adjustable air mattress structure according to claim 11, wherein when the plurality of first through-seams and the plurality of second through-seams cause respective opening edges to extend to positions inside each other's openings, the middle connecting parts are rotatable, with a maximum rotation angle of 90-180°; and when the plurality of first through-seams and the plurality of second through-seams cause respective opening edges to extend to positions above or below each other's openings, the middle connecting parts are compressible.

14. The thickness-adjustable air mattress structure according to claim 11, wherein the thickness-adjustable elastic sponge is a hexahedral sponge cushion, silicone cushion, rubber cushion, or latex cushion.

15. The thickness-adjustable air mattress structure according to claim 8, wherein a part of the thickness-adjustable elastic sponge between each two adjacent first through-seams forms an upper spacer; a part of the thickness-adjustable elastic sponge between each two adjacent second through-seams forms a lower spacer; and the upper spacer is parallel and misaligned with the lower spacer.

16. The thickness-adjustable air mattress structure according to claim 8, wherein the thickness-adjustable elastic sponge is in a shape of a square or long strip; the plurality of first through-seams and the plurality of second through-seams run through left and right side surfaces or front and rear side surfaces of the thickness-adjustable elastic sponge; the plurality of first through-seams and the plurality of second through-seams are spaced along the length or width direction of the thickness-adjustable elastic sponge; and the plurality of first through-seams do not intersect with the plurality of second through-seams.

* * * * *